US009696647B2

(12) United States Patent
Hori

(10) Patent No.: US 9,696,647 B2
(45) Date of Patent: Jul. 4, 2017

(54) ELECTROSTATIC LATENT IMAGE DEVELOPING TONER

(71) Applicant: KYOCERA Document Solutions Inc., Osaka (JP)

(72) Inventor: Hideharu Hori, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/188,162

(22) Filed: Jun. 21, 2016

(65) Prior Publication Data

US 2016/0378007 A1 Dec. 29, 2016

(30) Foreign Application Priority Data

Jun. 23, 2015 (JP) ..... 2015-125739

(51) Int. Cl.
*G03G 9/08* (2006.01)
*G03G 9/093* (2006.01)

(52) U.S. Cl.
CPC ..... *G03G 9/09371* (2013.01); *G03G 9/09321* (2013.01); *G03G 9/09328* (2013.01)

(58) Field of Classification Search
CPC ..... G03G 9/09328; G03G 9/09321; G03G 9/09371
USPC ..... 430/110.2
See application file for complete search history.

(56) References Cited

U.S. PATENT DOCUMENTS

2005/0271964 A1 12/2005 Etou et al.
2016/0187796 A1* 6/2016 Tsujihiro ..... G03G 9/09321 430/110.2
2016/0246201 A1* 8/2016 Kobayashi ..... G03G 9/09314

FOREIGN PATENT DOCUMENTS

JP 2004-138985 A 5/2004

* cited by examiner

*Primary Examiner* — Mark A Chapman
(74) *Attorney, Agent, or Firm* — Studebaker & Brackett PC

(57) ABSTRACT

An electrostatic latent image developing toner contains toner particles each containing a toner core, and a shell layer dividedly disposed as a plurality of segments on a surface of the toner core. The shell layer contains a hydrophobic thermoplastic resin and a hydrophilic thermosetting resin. A toner core-shell layer interface formation rate is $3.78\times10^{6}$ $m^{-1}$ or more and $7.02\times10^{6}$ $m^{-1}$ or less. A ratio of the hydrophobic thermoplastic resin to the toner core is 0.40% by mass or more and 1.55% by mass or less.

7 Claims, 6 Drawing Sheets

ELECTROSTATIC LATENT IMAGE DEVELOPING TONER

INCORPORATION BY REFERENCE

The present application claims priority under 35 U.S.C. §119 to Japanese Patent Application No. 2015-125739, filed Jun. 23, 2015. The contents of this application are incorporated herein by reference in their entirety.

BACKGROUND

The present disclosure relates to an electrostatic latent image developing toner.

From the viewpoint of energy saving and compactness of an image forming apparatus, a toner that can be well fixed without heating a fixing roller if possible is desired. In general, for preparing a toner excellent in low-temperature fixability, a binder resin having a low melting point or a low glass transition temperature, or a releasing agent having a low melting point is used in many cases. If such a toner is stored at a high temperature, however, there arises a problem in which toner particles contained in the toner are liable to aggregate. If the toner particles aggregate, the charge amount of the aggregated toner particles is liable to lower as compared with the charge amount of toner particles not aggregated.

Besides, for purpose of improving the low-temperature fixability and the high-temperature presability of a toner, a toner containing toner particles having a core-shell structure is sometimes used. For example, a toner containing toner particles each having a toner core that is coated with a thin film containing a hydrophilic thermosetting resin, and has a softening point of 40° C. or more and 150° C. or less is known.

SUMMARY

The electrostatic latent image developing toner of the present disclosure contains toner particles each containing a toner core, and a shell layer dividedly disposed as a plurality of segments on a surface of the toner core. The shell layer contains a hydrophobic thermoplastic resin and a hydrophilic thermosetting resin. A toner core-shell layer interface formation rate is $3.78\times10^6$ $m^{-1}$ or more and $7.02\times10^6$ $m^{-1}$ or less. A ratio of the hydrophobic thermoplastic resin to the toner core is 0.40% by mass or more and 1.55% by mass or less.

DETAILED DESCRIPTION

Figure 1:
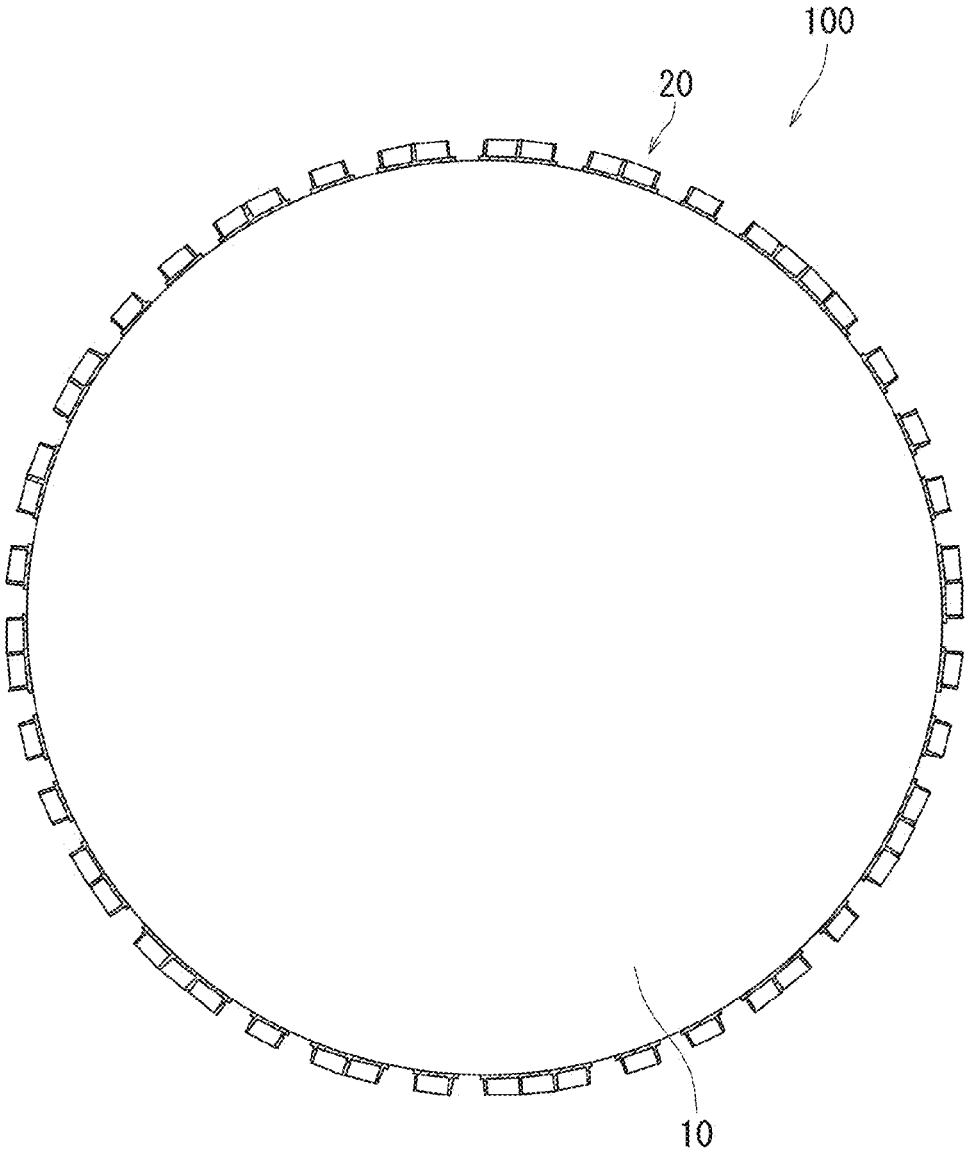
FIG. 1 is a schematic diagram illustrating an example of a toner particle contained in an electrostatic latent image developing toner according to an embodiment of the present disclosure.

A preferred embodiment of the present disclosure will now be described in detail. The present disclosure is not limited to the following embodiment and can be appropriately modified and changed within the scope of the object of the present disclosure. It is noted that the description may be appropriately omitted to avoid redundant description but the omission does not limit the scope of the present disclosure.

A toner according to the present embodiment is an electrostatic latent image developing toner (hereinafter sometimes simply referred to as the "toner"). The toner of the present embodiment is a powder containing a large number of toner particles. The toner of the present embodiment can be used in, for example, an electrophotographic apparatus (image forming apparatus). Incidentally, an evaluation result (i.e., a value corresponding to the shape, physical property or the like) of a powder (more specifically, toner cores, toner mother particles, an external additive, a toner, or the like) is, unless otherwise specified, a number average of values measured for an appropriate number of average particles selected from the powder.

Now, an example of an image forming method using an electrophotographic apparatus will be described. First, an electrostatic latent image is formed on a photosensitive member on the basis of image data. Next, the thus formed electrostatic latent image is developed by a two-component developer containing a carrier and a toner. In a developing step, a charged toner is caused to adhere to the electrostatic latent image to form a toner image on the photosensitive member. Thereafter, the toner image thus formed on the photosensitive member is transferred onto a transfer belt, and then, the toner image transferred onto the transfer belt is further transferred onto a recording medium (such as paper). Subsequently, the toner is heated to fix the toner image on the recording medium. In this manner, an image is formed on the recording medium. For example, if toner images of four colors of black, yellow, magenta and cyan are superimposed, a full color image can be formed.

The electrostatic latent image developing toner of the present embodiment contains toner particles. The electrostatic latent image developing toner of the present embodiment has the following features (1) to (3):

(1) Each toner particle includes a toner core, and a shell layer dividedly disposed as a plurality of segments on the surface of the toner core, and the shell layer contains a hydrophobic thermoplastic resin, and a hydrophilic thermosetting resin;

(2) a toner core-shell layer interface formation rate is $3.78\times10^6$ $m^{-1}$ or more and $7.02\times10^6$ $m^{-1}$ or less; and (3) a ratio of the hydrophobic thermoplastic resin to the toner core is 0.40% by mass or more and 1.55% by mass or less.

The feature (1) is useful for attaining both high-temperature preservability and low-temperature fixability of the electrostatic latent image developing toner. Since the toner core is covered with the shell layer, the high-temperature preservability of the electrostatic latent image developing toner can be improved. Besides, since the toner core is covered with the shell layer, the melting point or the glass transition temperature of the toner core can be lowered, so as to improve the low-temperature fixability. In the electrostatic latent image developing toner of the present embodiment, a part of the surface of the toner core is covered with the shell layer with another part of the surface not covered with the shell layer, which will be described in detail later.

Owing to the hydrophilic thermosetting resin contained in the shell layer, the high-temperature preservability of the electrostatic latent image developing toner can be improved as well as the electrostatic latent image developing toner is inhibited from adhering to a photosensitive drum. Besides, owing to the hydrophobic thermoplastic resin contained in the shell layer, the low-temperature fixability of the electrostatic latent image developing toner can be improved. In addition, owing to the hydrophobic thermoplastic resin contained in the shell layer, the shell layer is difficult to adsorb a water content, and hence, the charge decay of the electrostatic latent image developing toner can be inhibited, so as to improve the transfer efficiency of the electrostatic latent image developing toner.

Incidentally, in description given hereinafter, the hydrophobic thermoplastic resin contained in the shell layer is sometimes designated as a first shell resin, and the hydrophilic thermosetting resin contained in the shell layer is sometimes designated as a second shell resin.

The feature (2) is useful for attaining both the high-temperature preservability and the low-temperature fixability of the electrostatic latent image developing toner. If the toner core-shell layer interface formation rate is $3.78\times10^6$ $m^{-1}$ or more, the number of the segments of the shell layer disposed on the surface of the toner core is not too small, and hence, an exposed surface of one toner core is difficult to come into direct contact with an exposed surface of another toner core. Accordingly, aggregation of the toner particles can be inhibited even at a comparatively high temperature, resulting in improving the high-temperature preservability. Besides, since the segments of the shell layer are not too large and are separated from one another, the electrostatic latent image developing toner can be fixed on a recording medium at a comparatively low temperature, resulting in improving the low-temperature fixability.

Furthermore, if the number of the segments of the shell layer disposed on the surface of the toner core is too small, it is apprehended that the toner cannot be properly transferred from the photosensitive drum onto a recording medium, which may lower the transfer efficiency. If the toner core-shell layer interface formation rate is $3.78\times10^6$ $m^{-1}$ or more, however, the transfer efficiency can be improved.

On the other hand, if the toner core-shell layer interface formation rate is $7.02\times10^6$ $m^{-1}$ or less, the number of the segments of the shell layer disposed on the surface of the toner core is not too large, and hence, the electrostatic latent image developing toner can be fixed on a recording medium at a comparatively low temperature, resulting in improving the low-temperature fixability. In this manner, since an appropriate number of the segments of the shell layer are dispersed on the surface of the toner core, the high-temperature preservability and the low-temperature fixability of the electrostatic latent image developing toner are further improved.

Incidentally, if the amount of the second shell resin is too large as compared with that of the first shell resin, the number of the segments of the shell layer is typically increased, and furthermore, a charge decay constant tends to be lowered. If the toner core-shell layer interface formation rate is $7.02\times10^6$ $m^{-1}$ or less, however, the shell layer contains the second shell resin in an appropriately amount as compared with that of the first shell resin, and therefore, the charge decay of the electrostatic latent image developing toner is inhibited so that the charge retention can be improved as well as the transfer efficiency can be improved.

It is noted that the toner core-shell layer interface formation rate refers to a rate of the number of interfaces formed between the shell layer and the toner core not covered with the shell layer against a length of a measurement region linearly extending on the surface of the toner particle. The measurement region is, for example, a region on a straight line between both ends of the toner particle passing through the center of the toner particle in an image of the toner. Typically, if one island-shaped segment of the shell layer is present on the surface of the toner core in the measurement region of the toner particle, the number of formed interfaces (interface frequency) is two. The interface formation rate is obtained, for example, by taking an enlarged image of a dyed toner.

The toner core-shell layer interface formation rate can be controlled by an optional method. The method is not especially specified, but the toner core-shell layer interface formation rate can be controlled by changing, in the process of forming the shell layer, any one of a retention temperature before temperature increase, a retention time before the temperature increase, conditions for stirring a mixture before the temperature increase, and/or a peak temperature in the temperature increase.

The feature (3) is useful for attaining both the high-temperature preservability and the low-temperature fixability of the electrostatic latent image developing toner. If the ratio of the first shell resin to the toner core is too small, the shell layer may not effectively work to inhibit the aggregation of the toner particles. Therefore, if the ratio of the first shell resin to the toner core is 0.40% by mass or more, the amount of the first shell resin disposed on the surface of the toner core is not too small, and hence, the aggregation of the toner particles can be inhibited at a comparatively high temperature, resulting in improving the high-temperature preservability.

On the other hand, if the ratio of the first shell resin to the toner core is 1.55% by mass or less, the amount of the first shell resin disposed on the surface of the toner core is not too large, and hence, the electrostatic latent image developing toner can be fixed on a recording medium even at a comparatively low temperature, resulting in improving the low-temperature fixability. Besides, if the ratio of the first shell resin to the toner core is 1.55% by mass or less, the amount of the first shell resin disposed on the surface of the toner core is not too large, which probably inhibits the adhesion of the toner to the drum. Moreover, since an appropriate amount of the first shell resin is present in the shell layer disposed on the surface of the toner core, the charge retention can be improved as well as the charge decay can be inhibited.

In this manner, the electrostatic latent image developing toner of the present embodiment has the features (2) and (3), and the shell layer containing an appropriate amount of the first shell resin is dispersed on the surface of the toner dividedly as the segments having appropriate sizes.

As described above, the toner of the present embodiment has the features (1) to (3), and therefore, the high-temperature preservability, the low-temperature fixability, and the transfer efficiency can be improved, and the charge decay and the drum adhesion of the toner can be inhibited. Incidentally, the toner of the present embodiment having the features (1) to (3) may be used in the form of a mixture with another toner not having any of the features (1) to (3). If the toner of the present embodiment having the features (1) to (3) is mixed with another toner not having any of the features (1) to (3), the resultant mixed toner preferably contains the toner of the present embodiment in a ratio of preferably 80% by mass or more, and more preferably 90% by mass or more.

Incidentally, in order to further improve both the low-temperature fixability and the high-temperature preservability of the toner, for example, the electrostatic latent image developing toner preferably has the following feature (4) in addition to the features (1) to (3):

(4) In the shell layer, a plurality of blocks substantially composed of the hydrophobic thermoplastic resin (the first shell resin) are mutually connected through junction portions substantially composed of the hydrophilic thermosetting resin (the second shell resin). The amount of the hydrophobic thermoplastic resin contained in each block is preferably 80% by mass or more, more preferably 90% by mass or more, and most preferably 100% by mass. The amount of the hydrophilic thermosetting resin contained in each junction portion is preferably 80% by mass or more, more preferably 90% by mass or more, and most preferably 100% by mass.

The hydrophobic thermoplastic resin contained in the shell layer is softened when heated to a temperature equal to or higher than its glass transition temperature Tg. In the shell layer of the toner having the feature (4), however, the hydrophobic thermoplastic resin (in the form of blocks) is partitioned by the hydrophilic thermosetting resin (in the form of junction portions). Therefore, even if the temperature of the shell layer is increased to the glass transition temperature Tg of the hydrophobic thermoplastic resin, the toner particle is difficult to deform. Therefore, if the production conditions for the toner are controlled, the deformation of the toner particle can be allowed to start when heat and pressure are simultaneously applied to the toner particles contained in the toner. In such a toner, the aggregation of the toner particles is inhibited as long as a pressure is not applied to the toner. Accordingly, the toner having the feature (4) is excellent in both the high-temperature preservability and the low-temperature fixability.

Figure 2:
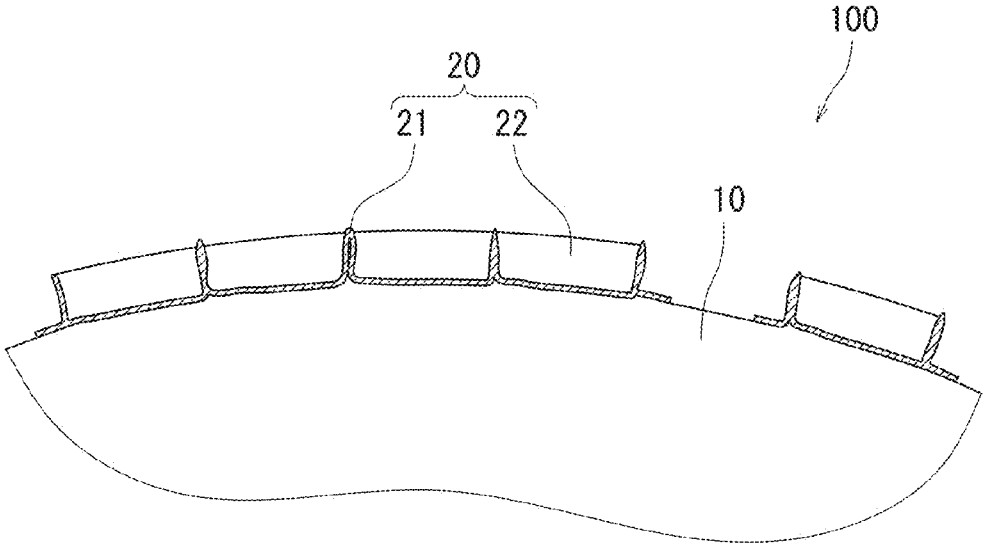
FIG. 2 is a schematic diagram illustrating an example of a shell layer structure of the electrostatic latent image developing toner according to the embodiment of the present disclosure.

Now, an example of the toner of the present embodiment will be described with reference to FIGS. 1 and 2. FIG. 1 is a schematic diagram of an example of a toner particle 100 contained in the electrostatic latent image developing toner according to the embodiment of the present disclosure. FIG. 2 is a schematic diagram of an exemplified structure of a shell layer 20 disposed on the toner particle 100.

As illustrated in FIG. 1, the toner particle 100 contains a toner core 10, and a shell layer 20 disposed dividedly as a plurality of segments on the surface of the toner core 10. The toner core 10 is covered with the plurality of segments of the shell layer 20. The shell layer 20 is formed separately in the shape of islands on the surface of the toner core 10. As illustrated in FIG. 2, the shell layer 20 includes a junction portion 21 and a block 22. The junction portion 21 is substantially composed of the hydrophilic thermosetting resin. The block 22 is substantially composed of the hydrophobic thermoplastic resin.

One segment of the shell layer 20 may be composed of a plurality of blocks 22. In this case, in each of a plurality of regions partitioned by the junction portion 21 of the hydrophilic thermosetting resin, the small block 22 of the hydrophobic thermoplastic resin is formed. The blocks 22 of the hydrophobic thermoplastic resin and the junction portion 21 of the hydrophilic thermosetting resin together form a plurality of segments of the shell layer 20 having a sea-island structure on the surface of the toner core 10.

One segment of the shell layer 20 may be composed of one block 22. In this case, in the shell layer 20, the small block 22 of the hydrophobic thermoplastic resin is formed in one region partitioned by the junction portion 21 of the hydrophilic thermosetting resin.

In the shell layer 20, each block 22 is typically exposed on the surface of the toner particle. However, the shell layer 20 may contain a block 22 not exposed on the surface of the toner particle.

Here, referring to mainly FIG. 2, the structure of the shell layer 20 will be described in more detail. As illustrated in FIG. 2, if one segment of the shell layer 20 includes a plurality of blocks, the junction portion 21 is formed between one block 22 and another block 22. The respective blocks 22 are partitioned by the junction portion 21 (namely, walls of the junction portion 21) disposed between the blocks 22 adjacent to each other. Besides, the junction portion 21 is further formed in a space between each of the blocks 22 and the toner core 10. The junction portion 21 (namely, a film of the junction portion 21) disposed in the space between the block 22 and the toner core 10 mutually connects the walls of the junction portion 21 adjacent to each other, so as to integrate the whole junction portion 21. The junction portion 21 is, however, not limited to this structure, but may be partially separated.

Besides, as illustrated in FIG. 2, if one segment of the shell layer 20 includes one block, the junction portion 21 is formed to surround the block 22 excluding its top surface. Also in this case, the junction portion 21 is formed also in a space between the block 22 and the toner core 10.

Incidentally, an external additive added as needed may be present on the surface of the toner particle 100 (a toner mother particle). Herein, a toner particle obtained before addition of an external additive is sometimes designated as a toner mother particle. Besides, the shell layer disposed on the surface of the toner core may be formed in a layered structure.

The toner may be used as a one-component developer. Alternatively, the toner may be mixed with a desired carrier to be used as a two-component developer.

[Toner Core]

The toner core contains a binder resin. The toner core may further contain an internal additive (for example, at least one of a colorant, a releasing agent, a charge control agent, and a magnetic powder). It is noted that the term "-based" following the name of a compound is herein used in some cases for comprehensively referring to the compound and derivatives thereof. If the term "-based" following the name of a compound is used for designating a polymer, it means that a repeating unit of the polymer is derived from the compound or a derivative thereof. Besides, the term "(meth) acrylic" is used in some cases for comprehensively referring to acrylic and methacrylic.

(Binder Resin)

The binder resin generally constitutes a large proportion (for example, 85% by mass or more) of components of each toner core. Properties of the binder resin are therefore expected to have great influence on the overall property of the toner core. For example, if the binder resin has an ester group, a hydroxyl group, an ether group, an acid group, or a methyl group, the toner core is highly likely to be anionic.

If the binder resin has an amino group or an amide group, the toner core is highly likely to be cationic. In order that the binder resin is strongly anionic, the hydroxyl value (the OHV value) and the acid value (the AV value) of the binder resin are preferably 10 mgKOH/g or more, and more preferably 20 mgKOH/g or more.

The binder resin preferably has at least one functional group selected from the group consisting of an ester group, a hydroxyl group, an ether group, an acid group, and a methyl group, and more preferably has the hydroxyl group and/or a carboxyl group as the acid group. The binder resin having such a functional group is likely to be reacted with and chemically bonded to a shell material (such as methylol melamine). If such a chemical bond is formed, the toner core and the shell layer are firmly bonded to each other. Besides, the binder resin also preferably has, in a molecule, a functional group containing active hydrogen.

The glass transition temperature Tg of the binder resin is preferably equal to or lower than a curing start temperature of the shell material. If the binder resin has such a glass transition temperature, the fixability of the toner is probably difficult to lower even in a high-speed fixing operation.

The glass transition temperature Tg of the binder resin is measured by using, for example, a differential scanning calorimeter. More specifically, a heat absorption curve of a sample (of the binder resin) is plotted using a differential scanning calorimeter, and the glass transition temperature Tg of the binder resin can be obtained based on a point of variation of the specific heat plotted on the obtained heat absorption curve.

The softening point Tm of the binder resin is preferably 100° C. or lower, and more preferably 95° C. or lower. If the softening point Tm of the binder resin is 100° C. or lower, the fixability of the toner is difficult to lower even in a high-speed fixing operation. Besides, if the softening point Tm of the binder resin is 100° C. or lower, the toner core is partially easily softened during a curing reaction of the shell layer in forming the shell layer on the surface of the toner core in an aqueous medium, and therefore, the toner core is easily rounded owing to surface tension. Incidentally, if a plurality of resins having different softening points Tm are used in combination, the softening point Tm of the binder resin can be controlled.

The softening point Tm of the binder resin can be measured by, for example, using a capillary rheometer. More specifically, a sample (of the binder resin) is set on a capillary rheometer to cause melt-flow of the binder resin under prescribed conditions, so as to plot an S-shaped curve of the binder resin. The softening point Tm of the binder resin can be read from the plotted S-shaped curve. The softening point Tm of the sample (of the binder resin) is a temperature on the plotted S-shaped curve corresponding to a stroke value of "$(S_1+S_2)/2$", where $S_1$ represents a maximum stroke value and $S_2$ represents a baseline stroke value on the low temperature side.

The binder resin preferably contains a thermoplastic resin. Preferable examples of the thermoplastic resin include homopolymers such as styrene-based resins, acrylic acid-based resins (more specifically, a polymer of acrylic acid ester, a polymer of methacrylic acid ester, and polymethyl methacrylate (PMMA)), olefin-based resins (more specifically, polyethylene resins and polypropylene resins), vinyl resins (more specifically, vinyl chloride resins, polyvinyl alcohols, vinyl ether resins, and N-vinyl resins), polyester resins, polyamide resins, and urethane resins; and copolymers each containing at least one repeating unit derived from the same monomer as a repeating unit of any of these homopolymers (more specifically, styrene-acrylic acid-based resins and styrene-butadiene-based resins). Among these, styrene-acrylic acid-based resins and polyester resins are particularly preferred for improving the dispersibility of a colorant in the toner, the chargeability of the toner, and the fixability of the toner on a recording medium.

A thermoplastic resin can be obtained through condensation polymerization or co-condensation polymerization of at least one thermoplastic monomer (more specifically, an acrylic acid-based monomer or a styrene-based monomer).

The styrene-acrylic acid-based resins usable as the binder resin will now be described. It is noted that a styrene-acrylic acid-based resin is a copolymer of a styrene-based monomer and an acrylic acid-based monomer. Styrene-based monomers and acrylic acid-based monomers, for example, mentioned below can be suitably used for synthesizing the styrene-acrylic acid-based resins. When an acrylic acid-based monomer is used, a carboxyl group can be introduced into the resultant styrene-acrylic acid-based resin. Furthermore, when a monomer having a hydroxyl group (more specifically, p-hydroxystyrene, m-hydroxystyrene, and (meth)acrylic acid hydroxyalkyl ester) is used, the hydroxyl group can be introduced into the resultant styrene-acrylic acid-based resin. When the amount of the acrylic acid-based monomer is adjusted, the acid value of the resultant styrene-acrylic acid-based resin can be controlled. When the amount of the monomer having a hydroxyl group is adjusted, the hydroxyl value of the resultant styrene-acrylic acid-based resin can be controlled.

Preferable examples of the styrene-based monomers include styrene, α-methylstyrene, p-hydroxystyrene, m-hydroxystyrene, vinyl toluene, α-chlorostyrene, o-chlorostyrene, m-chlorostyrene, p-chlorostyrene, and p-ethylstyrene.

Preferable examples of the acrylic acid-based monomer include (meth)acrylic acids, (meth)acrylic acid alkyl esters, and (meth)acrylic acid hydroxyalkyl esters. Preferable examples of the (meth)acrylic acid alkyl esters include methyl (meth)acrylate, ethyl (meth)acrylate, n-propyl (meth)acrylate, isopropyl (meth)acrylate, n-butyl (meth) acrylate, isobutyl (meth)acrylate, and 2-ethylhexyl (meth) acrylate. Preferable examples of the (meth)acrylic acid hydroxyalkyl esters include 2-hydroxyethyl (meth)acrylate, 3-hydroxypropyl (meth)acrylate, 2-hydroxypropyl (meth) acrylate, and 4-hydroxybutyl (meth)acrylate.

If a styrene-acrylic acid-based resin is used as the binder resin, in order to attain both the strength of the toner core and the fixability of the toner, the styrene-acrylic acid-based resin preferably has a number average molecular weight (Mn) of 2,000 or more and 3,000 or less. The styrene-acrylic acid-based resin preferably has a molecular weight distribution (a ratio Mw/Mn of a mass average molecular weight (Mw) to the number average molecular weight (Mn)) of 10 or more and 20 or less. Gel permeation chromatography can be employed for measuring the molecular weights Mn and Mw of the styrene-acrylic acid-based resin.

The polyester resins usable as the binder resin will now be described. A polyester resin can be prepared through condensation polymerization or co-condensation polymerization of an alcohol and a carboxylic acid. Examples of the alcohol that can be preferably used for synthesizing the polyester resin include dihydric alcohols (more specifically, diols and bisphenols) and tri- or higher-hydric alcohols, as listed below. Examples of the carboxylic acid that can be preferably used for synthesizing the polyester resin include dibasic carboxylic acids and tri- or higher carboxylic acids, as listed below.

Examples of the dihydric alcohols usable for preparing a polyester resin include diols and bisphenols.

Preferable examples of diols include ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol.

Preferable examples of bisphenols include bisphenol A, hydrogenated bisphenol A, bisphenol A ethylene oxide adduct, and bisphenol A propylene oxide adduct.

Preferable examples of tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Preferable examples of dibasic carboxylic acids include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acid (more specifically, n-butylsuccinic acid, isobutylsuccinic acid, n-octylsuccinic acid, n-dodecylsuccinic acid, and isododecylsuccinic acid), and alkenyl succinic acid (more specifically, n-butenylsuccinic acid, isobutenylsuccinic acid, n-octenylsuccinic acid, n-dodecenylsuccinic acid, and isododecenylsuccinic acid).

Preferable examples of tri- or higher carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra (methylenecarboxyl)methane, 1,2,7,8-octanetetracarboxylic acid, pyromellitic acid, and EMPOL trimer acid.

Note that the di-, tri-, or higher carboxylic acids may be deformed into ester-forming derivatives (more specifically, acid halides, acid anhydrides, and lower alkyl esters). The term "lower alkyl" herein is defined as an alkyl group having a carbon number of at least 1 and no greater than 6.

When the amounts of the alcohol and the carboxylic acid are respectively changed in the synthesis of the polyester resin, the acid value and the hydroxyl value of the polyester resin can be controlled. The acid value and the hydroxyl value of the polyester resin tend to be lowered by increasing the molecular weight of the polyester resin.

If a polyester resin is used as the binder resin, in order to attain both the strength of the toner core and the fixability of the toner, the polyester resin preferably has a number average molecular weight (Mn) of 1,000 or more and 2,000 or less. The polyester resin preferably has a molecular weight distribution (a ratio Mw/Mn of a mass average molecular weight (Mw) to the number average molecular weight (Mn)) of 9 or more and 21 or less. The gel permeation chromatography can be employed for measuring the molecular weights Mn and Mw of the polyester resin.

(Colorant)

The toner core may optionally contain a colorant. The colorant can be a known pigment or dye that matches the color of the toner. The amount of the colorant is preferably at least 1 part by mass and no greater than 20 parts by mass, and more preferably at least 3 parts by mass and no greater than 10 parts by mass relative to 100 parts by mass of the binder resin.

The toner core may contain a black colorant. Carbon black can be used as the black colorant. The black colorant may be a colorant that is adjusted to a black color using a yellow colorant, a magenta colorant, and a cyan colorant.

The toner core may contain a non-black colorant such as a yellow colorant, a magenta colorant, or a cyan colorant.

The yellow colorant can be at least one compound selected from the group consisting of condensed azo compounds, isoindolinone compounds, anthraquinone compounds, azo metal complexes, methine compounds, and arylamide compounds. Specific examples of the yellow colorant that can be preferably used include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow G and C.I. Vat Yellow.

The magenta colorant can be at least one compound selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Specific examples of the magenta colorant that can be preferably used include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

The cyan colorant can be at least one compound selected from the group consisting of copper phthalocyanine compounds, anthraquinone compounds, and basic dye lake compounds. Specific examples of the cyan colorant that can be preferably used include C.I. Pigment Blue (1, 7, 15, 15:1, 15:2, 15:3, 15:4, 60, 62, or 66), Phthalocyanine Blue, C.I. Vat Blue, and C.I. Acid Blue.

(Releasing Agent)

The toner core may optionally contain a releasing agent. The releasing agent is for example used in order to improve the fixability or the offset resistance of the toner. In order to increase anionic strength of the toner core, the toner core is preferably prepared using an anionic wax. In order to improve the fixability or the offset resistance of the toner, the amount of the releasing agent is preferably at least 1 part by mass and no greater than 30 parts by mass, and more preferably at least 5 parts by mass and no greater than 20 parts by mass relative to 100 parts by mass of the binder resin.

Examples of the releasing agent that can be preferably used include aliphatic hydrocarbon waxes (such as low molecular weight polyethylene, low molecular weight polypropylene, a polyolefin copolymer, a polyolefin wax, microcrystalline wax, paraffin wax, and Fischer-Tropsch wax), oxides of aliphatic hydrocarbon waxes (such as polyethylene oxide wax and a block copolymer of polyethylene oxide wax), plant waxes (such as candelilla wax, carnauba wax, Japan wax, jojoba wax, and rice wax), animal waxes (such as beeswax, lanolin, and spermaceti), mineral waxes (such as ozokerite, ceresin, and petrolatum), waxes having a fatty acid ester as a main component (such as montanic acid ester wax and castor wax), and waxes in which a fatty acid ester is partially or fully deoxidized (such as deoxidized carnauba wax).

A compatibilizer may be optionally added to the toner core in order to improve compatibility between the binder resin and the releasing agent.

(Charge Control Agent)

The toner core may optionally contain a charge control agent. The charge control agent is used, for example, in order to improve the charge stability or the charge rise characteristic of the toner. Besides, the anionic strength of the toner core can be increased if the toner core contains a negatively chargeable charge control agent. The charge rise characteristic of the toner is an indicator as to whether the toner can be charged to a specific charge level in a short period of time.

(Magnetic Powder)

The toner core may optionally contain a magnetic powder. Examples of a suitable material of the magnetic powder include ferromagnetic metals (more specifically, iron, cobalt, nickel, or an alloy containing at least one of these metals), ferromagnetic metal oxides (more specifically, ferrite, magnetite, and chromium dioxide), and ferromagnetized materials (more specifically, a carbon material having been ferromagnetized by heating).

The magnetic powder is preferably subjected to a surface treatment in order to inhibit elution of metal ions (for example, iron ions) from the magnetic powder. If the shell layer is formed on the surface of the toner core under acidic conditions, the elution of metal ions to the surface of the toner core causes the toner cores to adhere to one another more readily. The adhesion of the toner cores to one another can be inhibited by inhibiting the elution of metal ions from the magnetic powder.

[Shell Layer]

The shell layer contains the first shell resin and the second shell resin. The first shell resin preferably has a functional group (such as a hydroxyl group, a carboxyl group, an amino group, a carbodiimide group, an oxazoline group, or a glycidyl group) readily reactive with a functional group (such as a methylol group or an amino group) of the second shell resin. An amino group may be contained in the form of a carbamoyl group (—$CONH_2$) in the first shell resin.

The first shell resin is a hydrophobic thermoplastic resin as described above. Preferable examples of the hydrophobic thermoplastic resin include homopolymers such as acrylic acid-based resins, vinyl resins, urethane resins, and polyester resins, and copolymers each containing the same monomer as any of these homopolymers (such as styrene-acrylic acid-based copolymers, silicone-acrylic acid-based graft copolymers, and ethylene-vinyl alcohol copolymers).

Examples of a thermoplastic monomer usable for introducing the hydrophobic thermoplastic resin (the first shell resin) into the shell layer include (meth)acrylic acid alkyl esters such as methyl (meth)acrylate, ethyl (meth)acrylate, n-propyl (meth)acrylate, and n-butyl (meth)acrylate; (meth) acrylic acid aryl esters such as phenyl (meth)acrylate; (meth) acrylic acid hydroxyalkyl esters such as 2-hydroxyethyl (meth)acrylate, 3-hydroxypropyl (meth)acrylate, 2-hydroxypropyl (meth)acrylate, and 4-hydroxybutyl (meth) acrylate; (meth)acrylamide; ethylene oxide adducts of (meth)acrylic acid; and alkyl ethers of ethylene oxide adducts of (meth)acrylate (more specifically, methyl ether, ethyl ether, n-propyl ether, and n-butyl ether).

The second shell resin is a hydrophilic thermosetting resin as described above. Preferable examples of the second shell resin (the hydrophilic thermosetting resin) include melamine resins, urea resins, sulfonamide resins, glyoxal resins, guanamine resins, aniline resins, polyimide resins, and derivatives of these resins. A polyimide resin has a nitrogen atom in a molecular skeleton. Therefore, a shell layer containing a polyimide resin is likely to be strongly cationic. Examples of the polyimide resin include maleimide-based polymers and bismaleimide-based polymers (more specifically, amino bismaleimide polymers and bismaleimide triazine polymers).

The second shell resin is particularly preferably a resin produced through polycondensation of a compound having an amino group and an aldehyde (such as formaldehyde). It is noted that a melamine resin is a polycondensate of melamine and formaldehyde. A urea resin is a polycondensate of urea and formaldehyde. A glyoxal resin is a polycondensate of a reaction product of glyoxal and urea, and formaldehyde.

If a nitrogen atom is contained in the second shell resin, the crosslinking curing function of the second shell resin can be improved. In order to improve the reactivity of the second shell resin (a melamine resin, a urea resin, or a glyoxal resin), the content of the nitrogen atom is preferably controlled to be 40% by mass or more and 55% by mass or less in using a melamine resin, approximately 40% by mass in using a urea resin, and approximately 15% by mass in using a glyoxal resin.

Examples of a monomer usable for introducing the second shell resin (the hydrophilic thermosetting resin) into the shell layer include methylol melamine, benzoguanamine, acetoguanamine, spiroguanamine, and dimethylol dihydroxyethyleneurea (DMDHEU).

The shell layer may have a fracture portion (a portion having lower mechanical strength). The fracture portion can be formed by locally causing a defect or the like in the shell layer. If the shell layer has a fracture portion, the shell layer can be easily fractured. As a result, the toner can be fixed on a recording medium at a low temperature. The number of fracture portions can be optionally set.

[External Additive]

An external additive may be caused to adhere to the surface of the toner particle if necessary. As the external additive, a powder of a metal oxide (such as alumina, titanium oxide, magnesium oxide, zinc oxide, strontium titanate, or barium titanate), or silica can be used.

The external additive has a particle size of preferably 0.01 μm or more and 1.0 μm or less. The amount of the external additive to be used is preferably 0.5 parts by mass or more and 10 parts by mass or less, and more preferably 1 part by mass or more and 5 parts by mass or less relative to 100 parts by mass of the toner mother particle.

If the toner of the present embodiment is mixed with a desired carrier, a two-component developer can be prepared. In preparation of a two-component developer, a magnetic carrier is preferably used.

An example of a suitable carrier includes a powder of carrier particles each having a carrier core coated with a resin. Specific examples of the carrier core include a particle of a material such as iron, oxidized iron, reduced iron, magnetite, copper, silicon steel, ferrite, nickel, or cobalt; a particle of an alloy of such a material, and a metal such as manganese, zinc, or aluminum; a particle of an iron-nickel alloy or an iron-cobalt alloy; a particle of a ceramic (such as titanium oxide, aluminum oxide, copper oxide, magnesium oxide, lead oxide, zirconium oxide, silicon carbide, magnesium titanate, barium titanate, lithium titanate, lead titanate, lead zirconate, or lithium niobate); and a particle of a high-dielectric material (such as ammonium dihydrogen phosphate, potassium dihydrogen phosphate, or Rochelle salt). A resin carrier containing any of these particles dispersed in a resin may be used as a carrier.

Specific examples of the resin coating the carrier core include acrylic acid-based polymers, styrene-based polymers, styrene-acrylic acid-based copolymers, olefin-based polymers (such as polyethylene, chlorinated polyethylene, and polypropylene), polyvinyl chloride, polyvinyl acetate, polycarbonate, cellulose resins, polyester resins, unsaturated polyester resins, polyamide resins, urethane resins, epoxy resins, silicone resins, fluorine resins (such as polytetrafluoroethylene, polychlorotrifluoroethylene, and polyvinylidene fluoride), phenol resins, xylene resins, diallyl phthalate resins, polyacetal resins, and amino resins. Two or more of these resins may be used in combination.

The carrier has a particle size of preferably 20 μm or more and 120 μm or less, and more preferably 25 μm or more and 80 μm or less.

If the toner and the carrier are used to prepare a two-component developer, the content of the toner is preferably 3% by mass or more and 20% by mass or less, and more preferably 5% by mass or more and 15% by mass or less relative to the total mass of the two-component developer.

[Measurement of Interface Formation Rate]

The toner core-shell layer interface formation rate in the toner particle is obtained as follows:

Interface formation rate=Number of interfaces formed in measurement region/length of measurement region A linear measurement region on a toner particle is divided into a plurality of measurement units for the measurement. If measurement results are largely different between two measurement units adjacent to each other, an interface between the toner core and the shell layer is present in either of the two measurement units.

If, for example, brightness is measured in each of the measurement units, a difference in the brightness between two measurement units adjacent to each other is comparatively small unless an interface between the toner core and the shell layer is present in either of the two measurement units. On the other hand, if an interface between the toner core and the shell layer is present in either of the two measurement units adjacent to each other, a difference in the brightness between the two measurement units is comparatively large.

For example, the toner core-shell layer interface formation rate is measured on the basis of an image obtained by picturing a toner particle. As a microscope for taking an image of the toner particle, a field emission scanning electron microscope (FE-SEM) is suitably used. Here, the toner particles contained in the toner preferably do not contain an external additive. The toner particles may contain no external additive, or an external additive may be precedently removed from the toner particles before the measurement of the interface formation rate.

Incidentally, in order that the toner core and the shell layer can be easily distinguished from each other on the surface of the toner particle, the toner is preferably dyed with ruthenium before taking an image of the toner particle. In this case, a portion containing the hydrophobic thermoplastic resin in the shell layer of the toner particle is more easily dyed with ruthenium than a portion corresponding to the toner core. Accordingly, a portion corresponding to the shell layer attains a high brightness value while the portion corresponding to the toner core tends to have a comparatively low brightness value.

Next, the thus obtained image is analyzed by software. First, in one toner particle to be measured in the image, a straight line passing through the center of the toner particle is drawn, and this line is defined as a measurement region. If necessary, the image may be subjected to smoothing processing before drawing the straight line.

The measurement region is divided into a plurality of measurement units linearly arranged. For example, each of the linearly arranged measurement units has a length of preferably 5 nm or more and 40 nm or less, and more preferably 10 nm or more and 25 nm or less. If the toner particle has a particle size of approximately 10 μm, the number of measurement units is approximately 250 or more and approximately 2,000 or less.

As described above, if the toner is dyed with ruthenium, a region containing the hydrophobic thermoplastic resin is brighter than the other region. If the image is expressed using 255 gray scales, for example, a brightness value of the region containing the hydrophobic thermoplastic resin is larger by 10 gray scale levels or more as compared with a brightness value of the other region. Therefore, if a gray scale level of one measurement unit is higher than a gray scale level of an adjacent measurement unit by 10 gray scale levels or more, it can be determined that an interface between the toner core and the shell layer is present either of these two measurement units. Thus, the number of interfaces formed within the measurement region (interface frequency) can be counted. The toner core-shell layer interface formation rate can be obtained as a rate, against the length of the linearly extending measurement region (namely, the number of measurement units), of interfaces formed between the shell layer and a portion of the toner core not covered with the shell layer.

[Measurement of Ratio of First Shell Resin]

In the toner of the present embodiment, a ratio of the first shell resin to the toner core is obtained as follows. It is noted that the amount of the first shell resin is not the amount thereof added to a material used for forming the shell layer but is preferably a content of the first shell resin in the toner particle.

For example, the ratio of the first shell resin to the toner core may be obtained on the basis of a sample toner precedently prepared separately from the toner to be measured. In this case, the ratio of the first shell resin to the toner core may be measured using a calibration curve created based on a plurality of sample toners.

A sample toner is prepared, for example, by homogeneously dispersing the toner core and the first shell resin. Incidentally, although the toner to be measured may be or may not be washed, it is preferable that the sample toner is not washed.

Besides, it is preferable to prepare a plurality of sample toners respectively having different contents of the first shell resin and the same content of the toner core. If four sample toners are to be prepared, for example, a sample toner 0 is prepared by adding no first shell resin to the toner core, a sample toner 1 is prepared by adding 0.5 parts by mass of the first shell resin to 100 parts by mass of the toner core, a sample toner 2 is prepared by adding 1.5 parts by mass of the first shell resin to 100 parts by mass of the toner core, and a sample toner 3 is prepared by adding 2.5 parts by mass of the first shell resin to 100 parts by mass of the toner core.

Next, transmission spectra of the sample toners are measured. A transmission spectrum is measured using an absorption spectrometer. If a plurality of sample toners are measured, the transmission spectra are preferably normalized for the respective sample toners. The normalization of the transmission spectra is performed, for example, so that base values of the transmission spectra and peak values thereof can be the same among the transmission spectra.

Next, in the respective transmission spectra, transmittances at a prescribed wave number derived from the first shell resin are compared. For example, if the first shell resin contains styrene, a transmittance at a wave number of 698 $cm^{-1}$ derived from styrene is varied in accordance with the content of the first shell resin. Therefore, a calibration curve is created on the basis of the transmittances at the wave number of 698 $cm^{-1}$.

The transmission spectrum of the toner to be measured is measured to obtain a transmittance at the prescribed wave number derived from the first shell resin. When the measurement result of the toner to be measured is compared with the precedently created calibration curve, the ratio of the first shell resin to the toner core in the toner to be measured can be measured.

[Method for Producing Toner]

A method for producing the electrostatic latent image developing toner of the present embodiment will now be described. The method for producing the electrostatic latent image developing toner of the present embodiment includes a toner core preparing process and a shell layer forming process. The toner core preparing process involves preparing a toner core. The shell layer forming process involves adding the toner core prepared in the toner core preparing step, a first shell resin and a second shell resin precursor to a liquid (such as an aqueous medium). The shell layer forming process also involves heating the liquid to form a shell layer containing the first shell resin and a second shell resin on the surface of the toner core. The first shell resin is a hydrophobic thermoplastic resin, and the second shell resin is a hydrophilic thermosetting resin as described above.

(Toner Core Preparing Process)

The toner core preparing process preferably employs a pulverization method or an aggregation method.

In the pulverization method, a binder resin and internal additives (for example, a colorant, a releasing agent, a charge control agent, and a magnetic powder) are mixed. Next, the resultant mixture is melted and kneaded. The resultant kneaded product is subsequently pulverized. Thereafter, the resultant pulverized product is classified. As a result, a toner core having a desired particle size is prepared. The pulverization method enables relatively simple production of a toner core.

The aggregation method includes, for example, an aggregation step and a coalescence step. The aggregation step involves causing fine particles containing components of the toner core to aggregate in an aqueous medium to form aggregated particles. The coalescence step involves causing coalescence of the components contained in the aggregated particles to form toner cores. The aggregation method enables production of toner cores that tend to be uniform in shape and particle size.

(Shell Layer Forming Process)

The shell layer forming process involves forming a shell layer on the surface of the toner core. The shell layer is formed using the first shell resin and the second shell resin precursor. The formation of the shell layer is preferably carried out in an aqueous medium such as water in order to prevent dissolution of the binder resin or elution of the releasing agent. In the method for producing the toner of the present embodiment, the toner core prepared in the toner core preparing process, the first shell resin containing a repeating unit having an alcoholic hydroxyl group, and the second shell resin precursor are added to a liquid (such as an aqueous medium).

Now, referring mainly to FIG. 3, an example of the shell layer forming process performed in the method for producing the toner of the present embodiment will be described on the assumption that a hydrophobic thermoplastic resin is used as the first shell resin and that a hydrophilic thermosetting resin precursor is used as the second shell resin precursor.

In the shell layer forming process, the toner core, the hydrophilic thermosetting resin precursor, and the hydrophobic thermoplastic resin are added to the aqueous medium. Thus, the hydrophobic thermoplastic resin in the form of a particle is adsorbed to the surface of the toner core in the aqueous medium. Besides, the hydrophilic thermosetting resin precursor covers the surface of the toner core to which the hydrophobic thermoplastic resin in the form of a particle has adhered. In the shell layer forming process, for example, a suspension of the hydrophobic thermoplastic resin in the form of a particle, and the hydrophilic thermosetting resin precursor may be added to the aqueous medium, so as to cause the hydrophilic thermosetting resin precursor to adhere to cover the hydrophobic thermoplastic resin in the form of a particle, and thereafter, the toner core may be added to the aqueous medium, so as to cause the hydrophobic thermoplastic resin in the form of a particle, to which the hydrophilic thermosetting resin precursor has adhered, to adsorb to the surface of the toner core.

Figure 3:
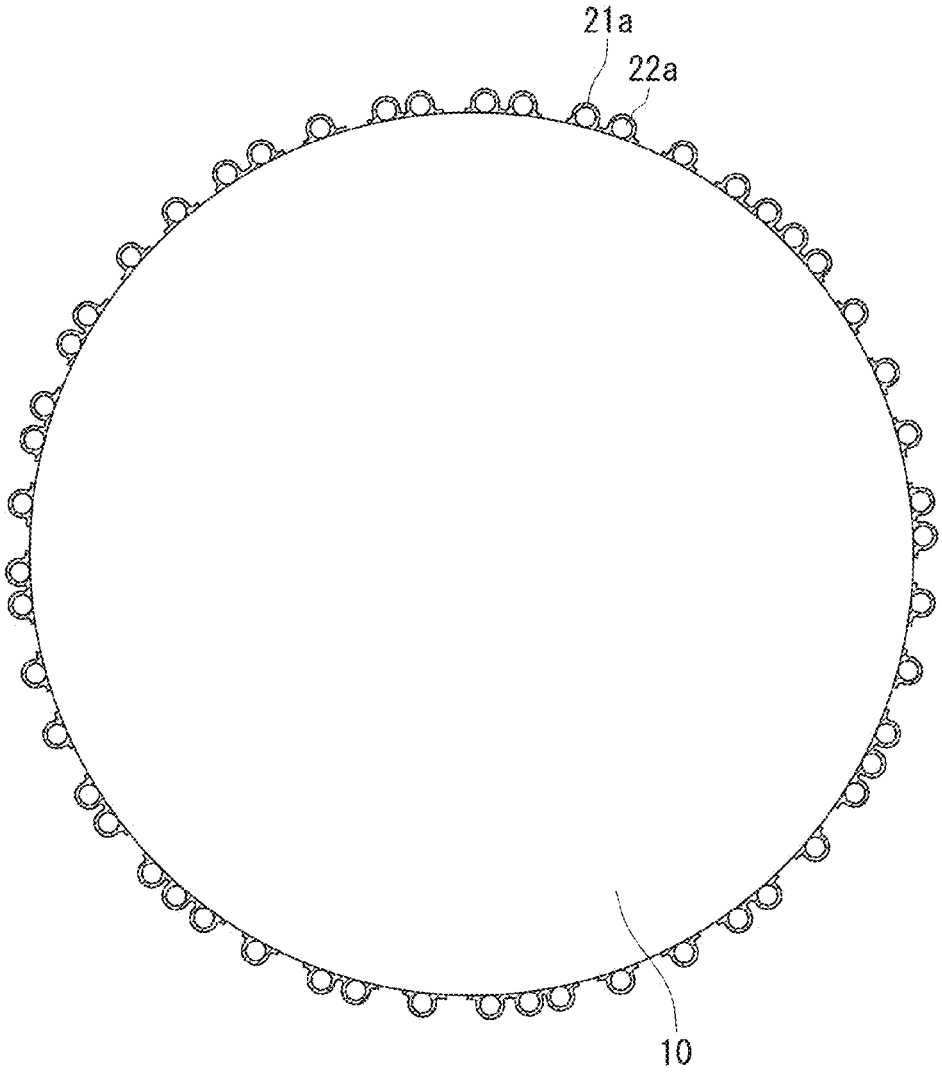
FIG. 3 is a schematic diagram illustrating a process of forming a shell layer of the electrostatic latent image developing toner according to the embodiment of the present disclosure.

More specifically, as illustrated in FIG. 3, a film 21*a* of the hydrophilic thermosetting resin precursor and a particle 22*a* of the hydrophobic thermoplastic resin are formed on the surface of the toner core 10. The film 21*a* and the particle 22*a* respectively adhere to the surface of the toner core 10. Since the hydrophobic thermoplastic resin has a hydrophobic property, it is presumed that it does not spread in the aqueous medium but aggregates to form the particle 22*a*. The particle 22*a* is probably not exposed to the aqueous medium because it is surrounded with the toner core 10 and the film 21*a*.

Subsequently, with stirring the aqueous medium (more specifically, a dispersion of the toner core 10 on which the film 21*a* and the particle 22*a* have been formed), the aqueous medium is heated to a prescribed temperature, and is retained at that temperature for a prescribed period of time. Thus, a polymerization reaction is caused in the hydrophilic thermosetting resin precursor, used as a shell material, adhering to the surface of the toner core 10, resulting in forming a hydrophilic thermosetting resin. Besides, the particle 22*a* is softened and deformed into a block shape. As a result, a shell layer containing the film 21*a* of the hydrophilic thermosetting resin, and the particle 22*a* of the hydrophobic thermoplastic resin is formed on the surface of the toner core 10.

Since the shell materials (the hydrophobic thermoplastic resin and the hydrophilic thermosetting resin precursor) are caused to adhere to the toner core before curing the shell layer, it is presumed that the particles of the hydrophobic thermoplastic resin are not fused to one another on the surface of the toner core even if the shell layer is cured by heating. Besides, since the hydrophilic thermosetting resin precursor before heating has a strong hydrophilic property, it is presumed that the hydrophilic thermosetting resin precursor is present on an interface between the aqueous medium and the particle of the hydrophobic thermoplastic resin. As the curing reaction of the shell layer is proceeded, however, the hydrophilic property of the hydrophilic thermosetting resin precursor tends to be lowered. Therefore, during the curing reaction of the shell layer, it is presumed that the hydrophilic thermosetting resin precursor enters, through capillary action, between the blocks of the hydrophobic thermoplastic resin, and further between the block of the hydrophobic thermoplastic resin and the toner core.

The aqueous medium is preferably adjusted to approximately pH 4 with an acid substance before the addition of the materials used for forming the shell layer. If the pH of the aqueous medium is controlled to the acid side, the polymerization reaction for forming the shell layer is promoted.

In order to satisfactorily proceed the formation of the shell layer, the temperature at which the shell layer is formed on the surface of the toner core is preferably 40° C. or higher and 95° C. or lower, and more preferably 50° C. or higher and 80° C. or lower.

If the shell layer is formed on the surface of the toner core in this manner, a dispersion of the toner mother particles can be obtained. Subsequently, the dispersion of the toner mother particles thus obtained is cooled to normal temperature. Thereafter, the toner is prepared from the dispersion of the toner mother particles by carrying out, as necessary, a step of washing the toner mother particles (washing step), a step of drying the toner mother particles (drying step), and a step of causing an external additive to adhere to the surfaces of the toner mother particles (external addition step).

The washing step involves washing the toner mother particles using water. Preferable washing methods include a method involving collecting a wet cake of the toner mother particles from the dispersion of toner mother particles by solid-liquid separation and washing the collected wet cake of toner mother particles using water, and a method involving causing sedimentation of the toner mother particles in the dispersion, exchanging a supernatant with water, and subsequently re-dispersing the toner mother particles in the water.

The drying step involves drying the toner mother particles. Preferable examples of methods for drying the toner mother particles include use of a dryer (more specifically, a spray dryer, a fluidized bed dryer, a vacuum freeze dryer, or a reduced pressure dryer). Use of a spray dryer is preferable in terms of inhibiting aggregation of the toner mother particles during drying. The spray dryer can be used to cause an external additive, such as silica particles, to adhere to the surfaces of the toner mother particles by spraying a dispersion of the external additive with the toner mother particles.

The external addition step involves causing an external additive to adhere to the surfaces of the toner mother particles. Preferable examples of methods for causing adhesion of the external additive include a method involving using a mixer (such as an FM mixer and a Nauta mixer (registered Japanese trademark)) to mix the toner mother particles and the external additive under conditions such that the external additive does not become embedded in the surfaces of the toner mother particles.

The method for producing the toner described above may be altered as appropriate in accordance with requirements of the toner, such as in terms of composition and properties. For example, the materials of the shell layer may be dissolved in a solvent prior to addition of the toner core to the solvent. Alternatively, the toner core may be added to a solvent prior to dissolving the materials of the shell layer in the solvent. The shell layer may be formed by any appropriate process. The shell layer may be formed, for example, through any of an in-situ polymerization process, an in-liquid curing coating process, and a coacervation process. Various steps may be omitted as appropriate depending on the intended use of the toner. In a situation in which an external additive is not caused to adhere to the surface of the toner mother particle (i.e., the external addition step is omitted), the toner mother particle and the toner particle are equivalent. In order to efficiently produce the toner, preferably a large number of toner particles are formed at the same time.

EXAMPLES

Examples of the present disclosure will now be described. Table 1 shows details of toners (electrostatic latent image developing toners) of Examples 1 to 9 and Comparative Examples 1 to 9.

TABLE 1

| | First shell resin | | | | | Second shell | 30° C. Retention | Ratio of first shell | Interface formation |
|---|---|---|---|---|---|---|---|---|---|
| | Type | Hydrophobic/ hydrophilic | Thermoplastic/ thermosetting | Tg (° C.) | Amount (mL) | resin (mL) | time (min) | resin (% by mass) | rate ($10^6/m^{-1}$) |
| Example 1 | I | Hydrophobic | Thermoplastic | 72 | 15 | 0.35 | 60 | 0.72 | 4.86 |
| Example 2 | I | Hydrophobic | Thermoplastic | 72 | 15 | 0.35 | 45 | 0.71 | 3.78 |
| Example 3 | I | Hydrophobic | Thermoplastic | 72 | 15 | 0.35 | 90 | 0.73 | 6.48 |
| Example 4 | I | Hydrophobic | Thermoplastic | 72 | 30 | 0.35 | 60 | 1.5 | 5.08 |
| Example 5 | I | Hydrophobic | Thermoplastic | 72 | 10 | 0.35 | 60 | 0.48 | 3.94 |
| Example 6 | II | Hydrophobic | Thermoplastic | 68 | 15 | 0.35 | 60 | 0.72 | 4.32 |
| Example 7 | III | Hydrophobic | Thermoplastic | 103 | 15 | 0.35 | 60 | 0.71 | 4.21 |
| Example 8 | I | Hydrophobic | Thermoplastic | 72 | 15 | 0.6 | 60 | 0.73 | 3.78 |
| Example 9 | I | Hydrophobic | Thermoplastic | 72 | 15 | 0.1 | 60 | 0.72 | 5.13 |
| Comparative Example 1 | I | Hydrophobic | Thermoplastic | 72 | 15 | 0.35 | 35 | 0.72 | 3.24 |
| Comparative Example 2 | I | Hydrophobic | Thermoplastic | 72 | 30 | 0.35 | 80 | 1.46 | 7.24 |
| Comparative Example 3 | I | Hydrophobic | Thermoplastic | 72 | 30 | 0.35 | 50 | 1.48 | 3.24 |
| Comparative Example 4 | I | Hydrophobic | Thermoplastic | 72 | 50 | 0.35 | 60 | 2.41 | 4.86 |
| Comparative Example 5 | I | Hydrophobic | Thermoplastic | 72 | 5 | 0.35 | 60 | 0.25 | 3.78 |
| Comparative Example 6 | IV | Water-soluble | Thermoplastic | 110 | 15 | 0.35 | 60 | 0.72 | 4.86 |
| Comparative Example 7 | V | Hydrophobic | Thermosetting | — | 15 | 0.35 | 60 | 0.71 | 5.94 |
| Comparative Example 8 | I | Hydrophobic | Thermoplastic | 72 | 15 | 1.2 | 60 | 0.75 | 20.52 |
| Comparative Example 9 | I | Hydrophobic | Thermoplastic | 72 | 15 | — | 60 | 0.38 | 6.48 |

(Preparation of Suspension I of First Shell Resin)

A 1 L three-necked flask equipped with a thermometer and a stirring impeller was charged with 815 mL of ion-exchanged water, and 75 mL of an anionic surfactant ("LATEMUL (registered Japanese trademark) WX" manufactured by Kao Corporation, sodium polyoxyethylene alkyl ether sulfate), followed by increasing the internal temperature of the flak with a water bath to 80° C. Thereafter, a mixture of 68 mL of styrene and 12 mL of butyl acrylate, and a solution of 0.5 g of potassium persulfate dissolved in 30 mL of ion-exchanged water were separately added in a dropwise manner to the flask over 5 hours each. The resultant was retained at 80° C. for 2 hours for completing polymerization to give a suspension I (solid content concentration: 8%) of the first shell resin. Through measurement with a transmission electron microscope, the volume median diameter (Do) of particles of the first shell resin contained in the thus obtained suspension I was measured to be 32 nm. Besides, through measurement with a differential scanning calorimeter, the glass transition temperature Tg of the particles of the first shell resin contained in the suspension I was measured to be 72° C.

(Preparation of Suspension II of First Shell Resin)

A suspension II (solid content concentration: 8%) of the first shell resin was prepared in the same manner as the suspension I of the first shell resin except that the amount of the anionic surfactant was changed from 75 mL to 25 mL. Through the measurement with a transmission electron microscope, the volume median diameter ($D_{50}$) of particles of the first shell resin contained in the thus obtained suspension II was measured to be 107 nm. Besides, through the measurement with a differential scanning calorimeter, the glass transition temperature Tg of the particles of the first shell resin contained in the suspension II was measured to be 68° C.

(Preparation of Suspension III of First Shell Resin)

A suspension III (solid content concentration: 8%) of the first shell resin was prepared in the same manner as the suspension I of the first shell resin except that no butyl acrylate was added and that the amount of styrene was changed from 68 mL to 100 mL. Through the measurement with a transmission electron microscope, the volume median diameter ($D_{50}$) of particles of the first shell resin contained in the thus obtained suspension III was measured to be 30 nm. Besides, through the measurement with a differential scanning calorimeter, the glass transition temperature Tg of the particles of the first shell resin contained in the suspension III was measured to be 103° C.

(Preparation of Aqueous Solution IV)

An aqueous solution IV (solid content concentration: 11%) of a water-soluble thermoplastic resin (water-soluble polyacrylamide: "BECKAMINE (registered Japanese trademark) A-1" manufactured by DIC Corporation) was prepared. The water-soluble thermoplastic resin contained in the aqueous solution IV had a glass transition temperature Tg of 110° C.

(Preparation of Suspension V of First Shell Resin)

A suspension V (solid content concentration: 8%) of the first shell resin was prepared in the same manner as the suspension I of the first shell resin except that no butyl acrylate was added, that 5 mL of divinylbenzene was added, and that the amount of styrene was changed from 68 mL to 95 mL. The volume median diameter ($D_{50}$) of particles of the first shell resin contained in the thus obtained suspension V was measured to be 30 nm. Besides, although the glass transition temperature Tg of the particles of the first shell resin contained in the suspension V was measured with a differential scanning calorimeter, the glass transition temperature was not observed. It was confirmed, based on this test result, that the first shell resin contained in the suspension V was a thermosetting resin.

Example 1

Preparation of Toner Core

An FM mixer (manufactured by Nippon Coke & Engineering Co., Ltd.) was used to mix 750 g of a low viscosity polyester resin (manufactured by Kao Corporation, Tg=38° C., Tm=65° C.), 100 g of a medium viscosity polyester resin (manufactured by Kao Corporation, Tg=53° C., Tm=84° C.), 150 g of a high viscosity polyester resin (manufactured by Kao Corporation, Tg=710° C., Tm=120° C.), 55 g of a releasing agent (carnauba wax, "Carnauba Wax No. 1" manufactured by S. Kato & Co.), and 40 g of a colorant (Phthalocyanine Blue, "KET Blue 111" manufactured by DIC Corporation) at 2,400 rpm. The resultant mixture was melt-kneaded using a twin-screw extruder ("PCM-30" manufactured by Ikegai Corp.) under conditions of a material input rate of 5 kg/hour, a shaft rotational speed of 160 rpm, and a temperature setting range of 100° C. to 130° C. The resultant kneaded product was cooled and then coarsely pulverized using a pulverizer ("Rotoplex 16/8", manufactured by former Toa Kikai Seisakusho KK). Next, the coarsely pulverized product was finely pulverized using a jet mill ("Model-I Supersonic Jet Mill" manufactured by Nippon Pneumatic Mfg. Co., Ltd.). Thereafter, the finely pulverized product was classified using a classifier ("Elbow Jet EJ-LABO" manufactured by Nittetsu Mining Co., Ltd.). As a result, a toner core was obtained.

(Shell Layer Forming Process)

A 1 L three-necked flask equipped with a thermometer and a stirring impeller was charged with 300 mL of ion-exchanged water, followed by retaining the internal temperature of the flask at 30° C. with a water bath. Next, dilute hydrochloric acid was added into the flask to adjust the pH of an aqueous medium in the flask to 4. After pH adjustment, 15 mL of the suspension I of the first shell resin, and 0.35 mL of an aqueous solution of a hexamethylol melamine prepolymer ("MIRBANE (registered Japanese trademark) resin SM-607" manufactured by Showa Denko K.K., solid content concentration: 80% by mass) were added into the flask as raw materials of a shell layer. The shell layer raw materials were dissolved in the aqueous medium to prepare an aqueous solution of the shell layer raw materials. Next, 300 g of the toner core was added to the prepared aqueous solution. Thereafter, the flask contents were stirred at a rotational speed of 200 rpm at 30° C. for 60 minutes (hereinafter which time is referred to as the 30° C. retention time). Next, 300 mL of ion-exchanged water was added into the flask. Thereafter, the internal temperature of the flask was increased to 70° C. at a rate of 1° C./minute while stirring the flask contents at a rotational speed of 100 rpm. After heating, the flask contents were stirred continuously for 2 hours at 70° C. at a rotational speed of 100 rpm. Thereafter, sodium hydroxide was added into the flask to adjust the pH of the flask contents to 7. Next, the flask contents were cooled to normal temperature to give a toner mother particle-containing dispersion.

(Washing Step)

A wet cake of toner mother particles was collected from the toner mother particle-containing dispersion using a Buchner funnel. The toner mother particles were then washed by re-dispersing the wet cake of the toner mother particles in ion-exchanged water. The toner mother particles were washed five times with ion-exchanged water as described above.

(Drying Step)

A slurry was prepared by dispersing the washed wet cake of the toner mother particles in 50% by mass aqueous ethanol solution. The prepared slurry was fed into a continuous type surface modifier ("Coatmizer (registered Japanese trademark)" manufactured by Freund Corporation) to dry the toner mother particles in the slurry, so as to give dry toner mother particles. Drying was carried out at a hot air temperature of 45° C. and a flow rate of 2 $m^3$/minute.

(External Addition Step)

An FM mixer (manufactured by Nippon Coke & Engineering Co., Ltd.) having a capacity of 10 L was used to mix 100 parts by mass of the toner mother particles resulting from the drying step and 1.0 part by mass of dry silica ("REA90" manufactured by Nippon Aerosil Co., Ltd.) for 5 minutes to cause the external additive to adhere to the surfaces of the toner mother particles. Thereafter, the resultant toner was sifted using a 200 mesh (opening 75 μm) sieve to obtain a toner of Example 1.

Example 2

A toner of Example 2 was obtained in the same manner as the toner of Example 1 except that the 30° C. retention time was changed from 60 minutes to 45 minutes in the shell layer forming process.

Example 3

A toner of Example 3 was obtained in the same manner as the toner of Example 1 except that the 30° C. retention time was changed from 60 minutes to 90 minutes in the shell layer forming process.

Example 4

A toner of Example 4 was obtained in the same manner as the toner of Example 1 except that the amount of the suspension I of the first shell resin added in the shell layer forming process was changed from 15 mL to 30 mL.

Example 5

A toner of Example 5 was obtained in the same manner as the toner of Example 1 except that the amount of the suspension I of the first shell resin added in the shell layer forming process was changed from 15 mL to 10 mL.

Example 6

A toner of Example 6 was obtained in the same manner as the toner of Example 1 except that 15 mL of the suspension I of the first shell resin was replaced with 15 mL of the suspension II of the first shell resin in the shell layer forming process.

Example 7

A toner of Example 7 was obtained in the same manner as the toner of Example 1 except that 15 mL of the suspension I of the first shell resin was replaced with 15 mL of the suspension III of the first shell resin in the shell layer forming process.

Example 8

A toner of Example 8 was obtained in the same manner as the toner of Example 1 except that the amount of the aqueous solution of the hexamethylol melamine prepolymer added in the shell layer forming process was changed from 0.35 mL to 0.60 mL.

Example 9

A toner of Example 9 was obtained in the same manner as the toner of Example 1 except that the amount of the aqueous solution of the hexamethylol melamine prepolymer added in the shell layer forming process was changed from 0.35 mL to 0.10 mL.

Comparative Example 1

A toner of Comparative Example 1 was obtained in the same manner as the toner of Example 1 except that the 30° C. retention time was changed from 60 minutes to 35 minutes in the shell layer forming process.

Comparative Example 2

A toner of Comparative Example 2 was obtained in the same manner as the toner of Example 1 except that the amount of the suspension I of the first shell resin added in the shell layer forming process was changed from 15 mL to 30 mL, and that the 30° C. retention time was changed from 60 minutes to 80 minutes in the shell layer forming process.

Comparative Example 3

A toner of Comparative Example 3 was obtained in the same manner as the toner of Example 1 except that the amount of the suspension I of the first shell resin added in the shell layer forming process was changed from 15 mL to 30 mL, and that the 30° C. retention time was changed from 60 minutes to 50 minutes in the shell layer forming process.

Comparative Example 4

A toner of Comparative Example 4 was obtained in the same manner as the toner of Example 1 except that the amount of the suspension I of the first shell resin added in the shell layer forming process was changed from 15 mL to 50 mL.

Comparative Example 5

A toner of Comparative Example 5 was obtained in the same manner as the toner of Example 1 except that the amount of the suspension I of the first shell resin added in the shell layer forming process was changed from 15 mL to 5 mL.

Comparative Example 6

A toner of Comparative Example 6 was obtained in the same manner as the toner of Example 1 except that 15 mL of the suspension I of the first shell resin was replaced with 15 mL of the aqueous solution IV in the shell layer forming process.

Comparative Example 7

A toner of Comparative Example 7 was obtained in the same manner as the toner of Example 1 except that 15 mL of the suspension I of the first shell resin was replaced with 15 mL of the suspension V of the thermosetting resin in the shell layer forming process.

Comparative Example 8

A toner of Comparative Example 8 was obtained in the same manner as the toner of Example 1 except that the amount of the aqueous solution of the hexamethylol melamine prepolymer added in the shell layer forming process was changed from 0.35 mL to 1.20 mL.

Comparative Example 9

A toner of Comparative Example 9 was obtained in the same manner as the toner of Example 1 except that the aqueous solution of the hexamethylol melamine prepolymer was not added in the shell layer forming process.

[Measurement Methods]

The ratio of the first shell resin and the toner core-shell layer interface formation rate were measured as follows.

(Toner Core-Shell Layer Interface Formation Rate)

A hermetic vessel was charged with 2 mL of a 5% by mass ruthenium tetroxide aqueous solution. Each of the toners of Examples 1 to 9 and Comparative Example 1 to 9 prior to the external addition was allowed to stand still for 5 minutes under atmospheric environment in the hermetic vessel. Subsequently, a field emission scanning electron microscope (SEM) ("JSM-7600F" manufactured by JEOL Ltd.) was used to take SEM images of the toners of Examples 1 to 9 and Comparative Examples 1 to 9 prior to the external addition. SEM observation was carried out under conditions of an acceleration voltage of 10.0 kV, an irradiation current of 70 μA, a magnification of ×5,000, and contrast of 5,000. The brightness of images was arbitrarily set.

Figure 4:
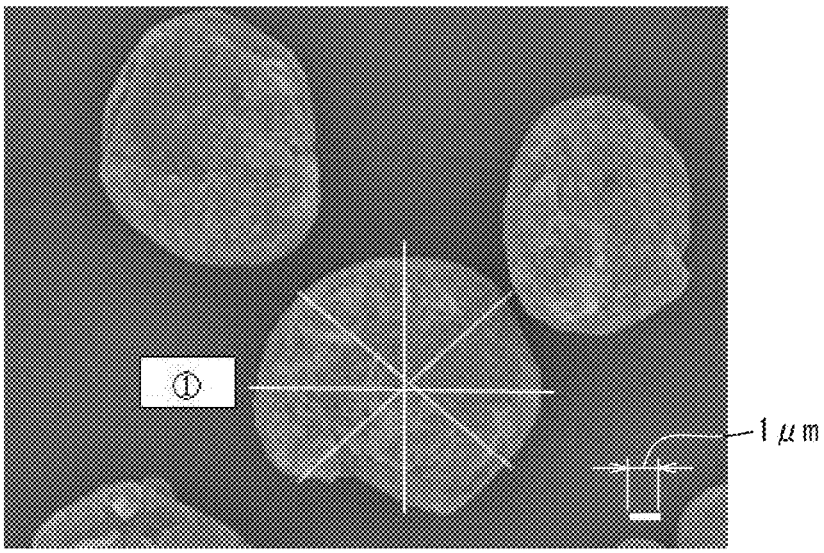
FIG. 4 is a diagram of an SEM photograph of the electrostatic latent image developing toner taken by a field emission scanning electron microscope.

Each of the thus obtained SEM images was analyzed by image analysis software ("WinROOF" manufactured by Mitani Corporation) to measure the interface formation rate. FIG. 4 is a diagram of an SEM photograph of a toner taken by the field emission scanning electron microscope.

An image file of the SEM image was subjected to 3×3 Gaussian filter processing to smooth the image. Subsequently, as illustrated in FIG. 4, four straight lines passing through the center of one toner particle in the SEM image and dividing the toner particle into equally divided eight portions were drawn, and with respect to each of these four lines, a brightness value of each measurement unit square with a side length of 1/54 μm was measured. If the brightness value of one measurement square was larger, by 10 or more, than a brightness value of either adjacent measurement square, it was determined that there was one interface. In accordance with the following equation, the toner core-shell layer interface formation rate was obtained:

Toner core-shell layer interface formation rate= (Number of formed interfaces)/(Length of measurement region on straight line)

Figure 5:
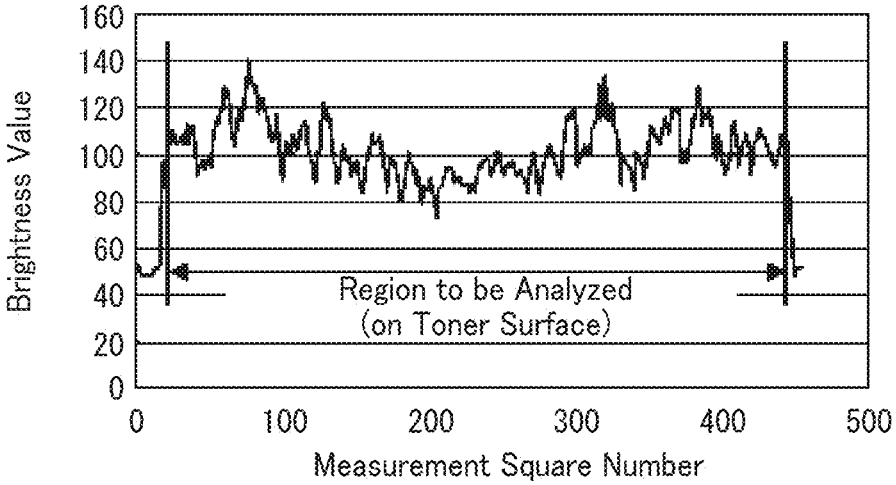
FIG. 5 is a graph of a brightness value on a toner particle surface of the electrostatic latent image developing toner according to the embodiment of the present disclosure.

FIG. 5 is a graph of brightness values obtained on one straight line on the surface of a toner particle of the toner of Example 1. Here, the number of formed interfaces was 32. The number of squares on the straight line was 342. Accordingly, with respect to this straight line, the toner core-shell layer interface formation rate was $5.08\times10^{6}$ $m^{-1}$. Similarly, such four straight lines were drawn with respect to each of at least 20 toner particles, the interface formation rate was calculated with respect to each of the straight lines, and an average of the interface formation rates was obtained. The interface formation rates of the toners of Examples 2 to 9 and Comparative Examples 1 to 9 were also similarly measured.

(Ratio of First Shell Resin)

The toner cores used in the production of the toner of Example 1 were dried to prepare a sample toner A. Besides, sample toners B, C and D were prepared by respectively adding, to the toner core used for preparing the toner of Example 1, different amounts of the particles of the first shell resin contained in the suspension I of the first shell resin, and homogeneously dispersing and drying the resultant. The weight ratio of the particles of the first shell resin added in the sample toner B was 0.493%. The weight ratio of the particles of the first shell resin added in the sample toner C was 1.48%. The weight ratio of the particles of the first shell resin added in the sample toner D was 2.47%. The sample toners A to D were not washed so as not to change the contents of the first shell resin.

Figure 6:
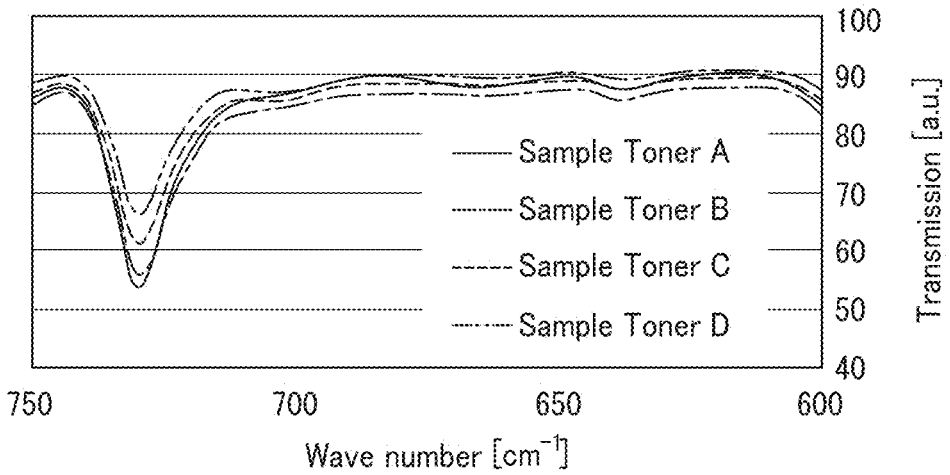
FIG. 6 is a graph of measurement results of transmission spectra of sample toners A to D.

A Fourier transform infrared spectrometer (FT-IR) ("Frontier FT-IR" manufactured by Perkin Elmer) was used to measure transmission spectra of the sample toners A to D. FIG. 6 is a graph of the thus measured transmission spectra of the sample toners A to D.

Figure 7:
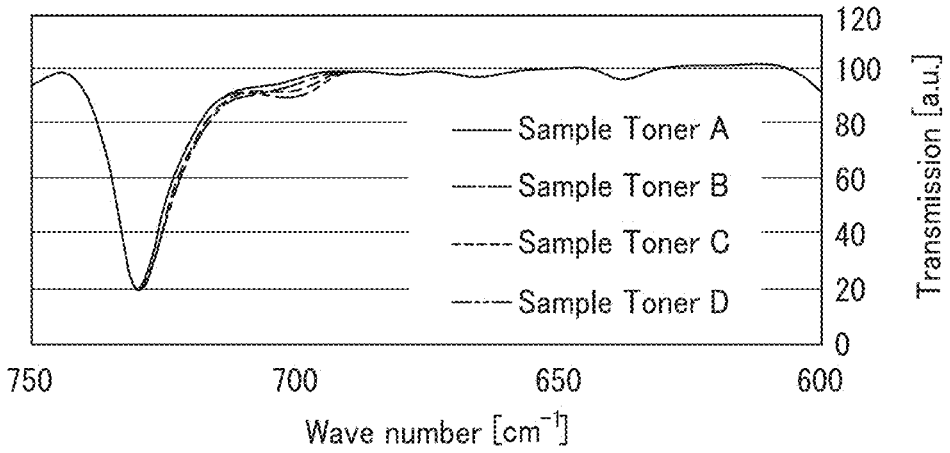
FIG. 7 is a graph obtained by normalizing the transmission spectra of the sample toners A to D.

Next, the transmission spectra were normalized through proportional adjustment of transmission spectrum amplitude so as to attain a transmittance of 100% at a wave number of 650 $cm^{-1}$ and a transmittance of 20% at a peak top at a wave number of 730 $cm^{-1}$. FIG. 7 is a graph of the thus normalized transmission spectra of the sample toners A to D.

Figure 8:
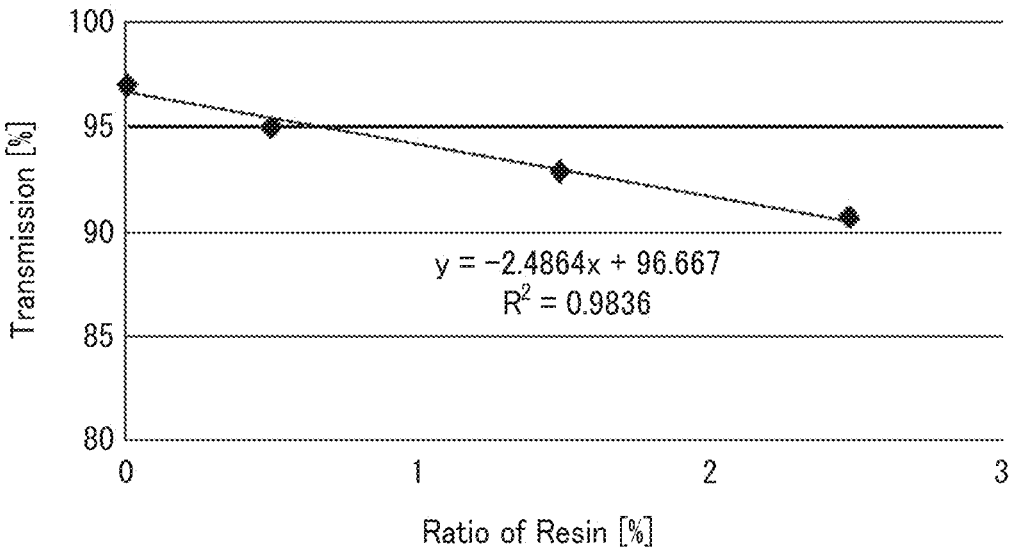
FIG. 8 is a graph of a calibration curve of a weight ratio of a thermoplastic resin used in the toner according to the embodiment of the present disclosure.

Then, with respect to each of the sample toners A to D, a transmittance at a wave number of 698 $cm^{-1}$, which is probably derived from styrene, in the normalized transmission spectrum was obtained, and a calibration curve was created on the basis of the relationship between the weight ratio of the first shell resin added to the sample toner and the transmittance. FIG. 8 is a graph of the calibration curve thus created using the sample toners A to D.

Incidentally, calibration curves were similarly created not only with respect to the suspension I of the first shell resin but also with respect to the suspensions II to V of the first shell resin. On the basis of the thus created calibration curves, a mass ratio of the first shell resin to the toner core was measured in each of the toners of Examples 1 to 9 and Comparative Examples 1 to 9.

[Evaluation Methods]

The toners of Examples 1 to 9 and Comparative Examples 1 to 9 were evaluated as follows.

(High-Temperature Preservability)

Two g of a sample (any of the toners) was weighed in a 20 mL polyethylene vessel, and the resultant was allowed to stand still for 3 hours in a thermostatic chamber set to 65° C. to obtain a sample for evaluation of the high-temperature preservability. Thereafter, the sample for the evaluation was sifted using a 100 mesh (opening 150 μm) sieve at a rheostat level of 5 for 30 seconds in accordance with a manual of a powder tester (manufactured by Hosokawa Micron Corporation). After sifting, the mass of the sample that did not pass through the sieve (hereinafter referred to as the toner mass post-sifting) was measured. The mass of the toner prior to sifting (hereinafter referred to as the toner mass pre-sifting) and the toner mass post-sifting were used to calculate a degree of aggregation (in % by mass) in accordance with the following equation. The high-temperature preservability was evaluated on the basis of the thus calculated degree of aggregation in accordance with the following criteria.

Degree of aggregation (% by mass)=(Toner mass post-sifting/toner mass pre-sifting)×100

Excellent: Degree of aggregation of lower than 40% by mass

Good: Degree of aggregation of 40% by mass or higher and lower than 50% by mass

Poor: Degree of aggregation of 50% by mass or higher (Low-Temperature Fixability)

A two-component developer for evaluation use was prepared by mixing 100 parts by mass of a developer carrier (carrier for "TASKalfa5550ci" manufactured by KYOCERA Document Solutions Inc.) and 10 parts by mass of each toner for 30 minutes using a ball mill.

A color printer ("FS-C5250DN" manufactured by KYOCERA Document Solutions Inc., modified to form an evaluation apparatus having adjustable fixing temperature) having a roller-roller type heat pressure fixing device (having a nip width of 8 mm) was used as an evaluation apparatus. The two-component developer prepared as described above was loaded into a developing device of the evaluation apparatus and a sample (any of the toners) was loaded into a toner container of the evaluation apparatus.

In order to evaluate the fixability of the sample (toner), the evaluation apparatus was used to form a solid image with a size of 25 mm×25 mm and a coverage of 100% on 90 g/m$^2$ paper (A4 size printing paper) under conditions of a linear speed of 200 mm/s (a nip passage time of 40 ms) and a toner application amount of 1.0 mg/cm$^2$. Next, the paper having the image formed thereon was passed through the fixing device. The fixing temperature was set in a range of 100° C. or higher and 200° C. or lower. More specifically, the fixing temperature of the fixing device was gradually increased from 100° C. to measure a minimum temperature at which the toner (solid image) could be fixed to the paper (minimum fixing temperature).

In the measurement of the minimum fixing temperature, the minimum fixing temperature was determined as a lowest temperature among fixing temperatures at which the solid image could be fixed on a recording medium without causing offset. The low-temperature fixability was evaluated in accordance with the following criteria:

Excellent: Minimum fixing temperature of 145° C. or lower

Good: Minimum fixing temperature of higher than 145° C. and 150° C. or lower

Poor: Minimum fixing temperature of higher than 150° C.

(Charge Decay Constant)

The charge decay constant α of (the toner particle of) each toner was measured in accordance with Japan Industrial Standard (JIS) C 61340-2-1 using an electrostatic diffusivity measuring device ("NS-D100" manufactured by Nano Seeds Corporation) as follows:

The toner was placed into a measurement cell. The measurement cell was a metal cell with a recess having an inner diameter of 10 mm and a depth of 1 mm. The sample was filled in the recess of the cell by being thrust from above using a glass slide. A portion of the sample brimming over the cell was removed by reciprocating the glass slide on the surface of the cell. At least 0.04 g and no greater than 0.06 g of sample was filled in the cell.

Subsequently, the measurement cell in which the sample was filled was left for 12 hours in an environment of a temperature of 32° C. and a humidity of 80% RH. Thereafter, the measurement cell was grounded and placed in the electrostatic diffusivity measuring device. Ions were then supplied to the sample through corona discharge to charge the sample under a condition of a charging period of 0.5 seconds. After elapse of 0.7 seconds from completion of the corona discharge, the surface potential of the sample was measured continuously in an environment of a temperature of 32° C. and a humidity of 80% RH. The charge decay constant (charge decay rate) α was calculated based on the measured surface potential and an equation $V=V_0\exp(-\alpha\sqrt{t})$. In the equation, V, $V_0$, and t represent a surface potential [V], an initial surface potential [V], and a decay period [second], respectively.

The charge decay constant α thus calculated was evaluated in accordance with the following criteria:

Excellent: Charge decay constant α of smaller than 0.014

Good: Charge decay constant α of 0.014 or larger and smaller than 0.015

Poor: Charge decay constant α of larger than 0.015

(Transfer Efficiency and Drum Adhesion)

For evaluating the transfer efficiency and drum adhesion of each toner, an evaluation apparatus ("TASKalfa5550ci" manufactured by KYOCERA document solutions Inc.) was used. The above-described developer was loaded in the evaluation apparatus, and with a sample (any of the toners) supplemented, an image with a coverage of 5% was output in an environment of a temperature of 32° C. and a humidity of 80% RH.

For evaluating the drum adhesion of the toner, it was appropriately observed, during the image output, whether or not the surface of a photosensitive drum of the evaluation apparatus was colored with the toner, and whether or not a dash mark was formed in a solid image. If a dash mark was formed in a solid image before printing 10,000 sheets, the image output was stopped at this time point. If 10,000 sheets could not be output, the number of sheets output up to the stop of the image output is shown as an evaluation result. The drum adhesion property of each sample was evaluated in accordance with the following criteria:

Good: Surface of photosensitive drum not colored with toner, and no dash mark observed in solid image Poor: Surface of photosensitive drum colored with toner, and dash mark observed in solid image After outputting 10,000 sheets, the weight of consumed toner and the weight of collected toner were measured, so as to calculate transfer efficiency of the sample in accordance with the following equation. The transfer efficiency was evaluated in accordance with the following criteria:

$$\text{Transfer efficiency (\%)}=\{(\text{Mass of consumed toner}-\text{Mass of collected toner})/(\text{Mass of consumed toner})\}\times 100$$

Excellent: Transfer efficiency of higher than 85%

Good: Transfer efficiency of higher than 80% and 85% or lower

Poor: Transfer efficiency of 80% or lower

It is noted that a portion of the sample (the toner) loaded in the toner container of the evaluation apparatus and discharged from the toner container during the image output was defined as the consumed toner. Besides, a portion of the consumed toner not transferred to recording media was defined as the collected toner.

[Evaluation Results]

The evaluation results of the toners of Examples 1 to 9 and Comparative Examples 1 to 9 are as follows. Table 2 shows the results of the evaluation for the high-temperature preservability, the low-temperature fixability, the charge decay constant, the drum adhesion, and the transfer efficiency of the toners of Examples 1 to 9 and Comparative Examples 1 to 9.

TABLE 2

| | Heat-resistant storage stability (% by mass) | Evaluation | Low-temperature fixability (° C.) | Evaluation | Charge decay constant (—) | Evaluation | Drum adhesion Output sheets | Evaluation | Transfer efficiency (%) | Evaluation |
|---|---|---|---|---|---|---|---|---|---|---|
| Example 1 | 22 | Excellent | 140 | Excellent | 0.011 | Excellent | — | Good | 92 | Excellent |
| Example 2 | 10 | Excellent | 148 | Good | 0.009 | Excellent | — | Good | 90 | Excellent |
| Example 3 | 46 | Good | 130 | Excellent | 0.014 | Good | — | Good | 92 | Excellent |
| Example 4 | 9 | Excellent | 146 | Good | 0.011 | Excellent | — | Good | 94 | Excellent |
| Example 5 | 44 | Good | 132 | Excellent | 0.01 | Excellent | — | Good | 90 | Excellent |
| Example 6 | 40 | Good | 136 | Excellent | 0.013 | Excellent | — | Good | 90 | Excellent |
| Example 7 | 12 | Excellent | 150 | Good | 0.008 | Excellent | — | Good | 95 | Excellent |
| Example 8 | 8 | Excellent | 150 | Good | 0.012 | Excellent | — | Good | 92 | Excellent |
| Example 9 | 48 | Good | 144 | Excellent | 0.01 | Excellent | — | Good | 93 | Excellent |
| Comparative Example 1 | 58 | Poor | 136 | Excellent | 0.011 | Excellent | — | Good | 80 | Poor |
| Comparative Example 2 | 24 | Excellent | 154 | Poor | 0.01 | Excellent | — | Good | 85 | Good |
| Comparative Example 3 | 6 | Excellent | 158 | Poor | 0.009 | Excellent | — | Good | 90 | Excellent |
| Comparative Example 4 | 12 | Excellent | 152 | Poor | 0.006 | Excellent | 800 | Poor | — | — |
| Comparative Example 5 | 68 | Poor | 130 | Excellent | 0.014 | Good | — | Good | 85 | Good |
| Comparative Example 6 | 42 | Good | 140 | Excellent | 0.34 | Poor | — | Good | 43 | Poor |
| Comparative Example 7 | 3 | Excellent | 170 | Poor | 0.008 | Excellent | — | Good | 95 | Excellent |
| Comparative Example 8 | 9 | Excellent | 168 | Poor | 0.139 | Poor | — | Good | 67 | Poor |
| Comparative Example 9 | 59 | Poor | 142 | Excellent | 0.008 | Excellent | 200 | Poor | — | — |

As shown in Table 2, the toner of Comparative Example 1 could not attain sufficient high-temperature preservability and transfer efficiency because of its low interface formation rate. The toner of Comparative Example 2 could not attain sufficient low-temperature fixability because of its high interface formation rate. The toner of Comparative Example 3 could not attain sufficient low-temperature fixability because of its low interface formation rate. The toner of Comparative Example 4 could not attain sufficient low-temperature fixability and be adhered onto the photosensitive drum because of its high ratio of the first shell resin to the toner core. The toner of Comparative Example 5 could not attain sufficient high-temperature preservability because of its low ratio of the first shell resin to the toner core.

The toner of Comparative Example 6 could not attain sufficient transfer efficiency since the water-soluble thermoplastic resin was used as the first shell resin and hence the charge decay constant was low. The toner of Comparative Example 7 could not attain sufficient low-temperature fixability since the hydrophobic thermosetting resin was used as the first shell resin. The toner of Comparative Example 8 could not attain sufficient low-temperature fixability because of its high interface formation rate, and could not attain sufficient transfer efficiency because of its low charge decay constant. The toner of Comparative Example 9 could not attain sufficient high-temperature preservability and be adhered onto the photosensitive drum since its shell layer did not contain a second shell resin.

On the contrary, the toners of Examples 1 to 9 were improved in the high-temperature preservability, the low-temperature fixability, and the transfer efficiency, and the charge decay and the drum adhesion of the toners could be inhibited.

What is claimed is:

1. An electrostatic latent image developing toner, comprising toner particles each containing a toner core, and a shell layer dividedly disposed as a plurality of segments on a surface of the toner core, wherein the shell layer contains a hydrophobic thermoplastic resin and a hydrophilic thermosetting resin, a toner core-shell layer interface formation rate is $3.78\times10^{6}$ $m^{-1}$ or more and $7.02\times10^{6}$ $m^{-1}$ or less, and a ratio of the hydrophobic thermoplastic resin to the toner core is 0.40% by mass or more and 1.55% by mass or less.

2. The electrostatic latent image developing toner according to claim 1, wherein the hydrophilic thermosetting resin is at least one resin selected from the group consisting of melamine resins, urea resins, and glyoxal resins.

3. The electrostatic latent image developing toner according to claim 1, wherein a plurality of blocks substantially composed of the hydrophobic thermoplastic resin are mutually connected via a junction portion substantially composed of the hydrophilic thermosetting resin in the shell layer.

4. The electrostatic latent image developing toner according to claim 1, wherein the hydrophobic thermoplastic resin contains a styrene-acrylic acid-based resin.

5. The electrostatic latent image developing toner according to claim 1, wherein the hydrophobic thermoplastic resin contains an acrylic acid-based resin.

6. The electrostatic latent image developing toner according to claim 1, wherein the hydrophilic thermosetting resin contains a melamine resin.

7. The electrostatic latent image developing toner according to claim 1, wherein the toner core contains a polyester resin.

* * * * *